US006217095B1

(12) United States Patent
Yamada

(10) Patent No.: US 6,217,095 B1
(45) Date of Patent: Apr. 17, 2001

(54) HAND STRAP FOR A PORTABLE APPARATUS

(75) Inventor: Kazumori Yamada, Shizuoka (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/200,519

(22) Filed: Nov. 25, 1998

(30) Foreign Application Priority Data

Nov. 26, 1997 (JP) ..... 9-324733

(51) Int. Cl.[7] ..... A45C 13/30

(52) U.S. Cl. ..... 294/149; 16/114.1; 224/218; 224/908; 294/139; 294/150

(58) Field of Search ..... 294/25, 137, 139, 294/149, 150, 158; 24/17 A, 115 R, 115 G, 115 H, 115 K, 115 M, 127, 129 A, 132 R, 132 AA; 224/217–222, 255, 258, 268, 908, 910; 16/110.1, 113.1, 114.1, 408, 411, 422, 428, 442, 444; 190/115, 116

(56) References Cited

U.S. PATENT DOCUMENTS

| | | | | |
|---|---|---|---|---|
| 3,225,984 | * | 12/1965 | Hyman | 294/150 X |
| 3,522,766 | * | 8/1970 | Wolbarst | 224/908 X |
| 3,938,166 | * | 2/1976 | Sloop | 224/908 X |
| 4,322,077 | * | 3/1982 | Van't Hof | 224/221 X |
| 4,610,476 | * | 9/1986 | Keiner | 294/149 |
| 4,896,403 | * | 1/1990 | Vouros | 24/115 H X |
| 5,307,966 | * | 5/1994 | Inaba et al. | 224/908 X |
| 5,345,656 | * | 9/1994 | Merritt | 24/115 H |
| 5,636,409 | * | 6/1997 | Akins | 294/139 X |

FOREIGN PATENT DOCUMENTS

| | | |
|---|---|---|
| 57-137327 | 8/1982 | (JP) . |
| 58-139402 | 8/1983 | (JP) . |
| 60-970 | 1/1985 | (JP) . |
| 61-1876 | 7/1986 | (JP) . |
| 5-218884 | 8/1993 | (JP) . |
| 3010310 | 2/1995 | (JP) . |
| 8-10030 | 1/1996 | (JP) . |
| 8-10031 | 1/1996 | (JP) . |
| 8-274852 | 10/1996 | (JP) . |
| 3036848 | 2/1997 | (JP) . |
| 3040194 | 5/1997 | (JP) . |

* cited by examiner

*Primary Examiner*—Johnny D. Cherry
(74) *Attorney, Agent, or Firm*—Scully, Scott, Murphy & Presser

(57) ABSTRACT

A hand strap for a portable apparatus is disclosed which can be easily and surely held by hand, prevents the apparatus from being dropped by accident, and reduces the cost. The hand strap is made up of a strap body implemented by one or two strings or strips anchored to the engaging portion of the apparatus, and a stop capable of being locked to the strap body at any desired position. The hand strap can therefore be held without requiring the user to put the user's hand in a loop. This allows the user to safely carry the apparatus simply by gripping the strap. A structure for mounting such a hand strap to the apparatus is also disclosed.

5 Claims, 4 Drawing Sheets

HAND STRAP FOR A PORTABLE APPARATUS

BACKGROUND OF THE INVENTION

The present invention relates to a hand strap for a portable apparatus and a structure for mounting the same. More particularly, the present invention is concerned with a hand strap mounted on a handy phone for allowing the user of the phone to easily hold or carry the phone while preventing the user from dropping the phone by accident, and a structure for mounting the same.

A hand strap for use with a handy phone or similar portable apparatus has been proposed in various forms in the past. One of conventional hand straps is implemented by a relatively wide strip having its opposite ends connected together to form a loop. A hand strap taught in, e.g. Japanese Patent Laid-Open Publication No. 8-10031 can be adjusted in length, as desired. In any case, the user of the apparatus holds or carries the apparatus by putting one hand in the loop. The hand strap additionally serves to prevent the apparatus from being dropped by accident.

However, the conventional hand straps have some problems left unsolved, as follows. Because it is troublesome for the user to put his or her hand in the loop of the hand strap, the user, in many cases, directly grips the apparatus and is therefore apt to drop the apparatus. The hand strap implemented by a relatively wide strip has a fixed length which sometimes does not match the size of the user's hand, resulting in uneasy operation. The hand strap with a variable length is disadvantageous in that when its length is reduced, the long excess portion hangs down and not only obstructs the user's operation, but also degrades the appearance of the apparatus. In addition, both of such conventional hand straps need an additional loop on the apparatus and a connecting portion which would obstruct the user's operation.

Technologies relating to the present invention are also disclosed in, e.g., Japanese Patent Laid-Open Publication No. 58-139402, Japanese Utility Model Laid-Open Publication Nos. 60-970 and 61-1876, and Japanese Patent Laid-Open Publication Nos. 5-218884, 8-10030, and 8-274852.

SUMMARY OF THE INVENTION

It is therefore an object of the present invention to provide a hand strap for a portable apparatus which is easy to operate and hold, prevents the apparatus from being dropped by accident, and reduces the cost, and a structure for mounting the same.

A hand strap for a portable apparatus of the present invention includes a strap body anchored at one end to an engaging port ion formed in the preselected position of a casing included in the apparatus. A stop is capable of being locked to the strap body at any desired position with the other end of the strap body being passed through the stop. The stop prevents the user's fingers holding the strap body from slipping.

BRIEF DESCRIPTION OF THE DRAWINGS

The above and other objects, features and advantages of the present invention will become more apparent from the following detailed description taken with the accompanying drawings in which.

DESCRIPTION OF THE PREFFED EMBODIMENTS

Figure 1:
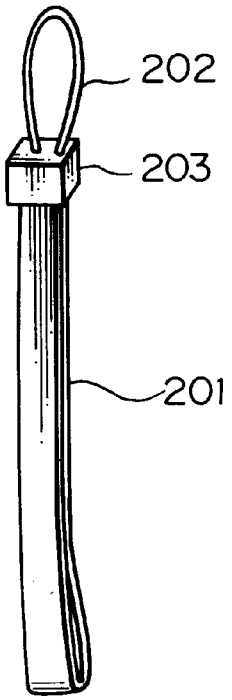
Fig. 1 PRIOR ART
FIG. 1 is a perspective view showing a conventional hand strap.

To better understand the present invention, brief reference will be made to a conventional hand strap for a portable apparatus, shown in FIG. 1. As shown, the hand strap is made up of a first loop strap 201, a second loop strap 202, and a connecting piece 203 connecting the two loop straps 201 and 202 to each other. The first loop strap 201 is implemented by a relatively wide strip connected at opposite ends to form a loop. The second loop strap 202 is implemented by a relatively narrow strip connected at opposite ends to form a comparatively small loop. The loop strap 202 is affixed to a portable apparatus. The user of the portable apparatus may put one hand in the loop strap 201 in order to hold or carry the apparatus. Such a loop strap additionally serves to prevent the operator from dropping the apparatus by accident.

Figure 2:
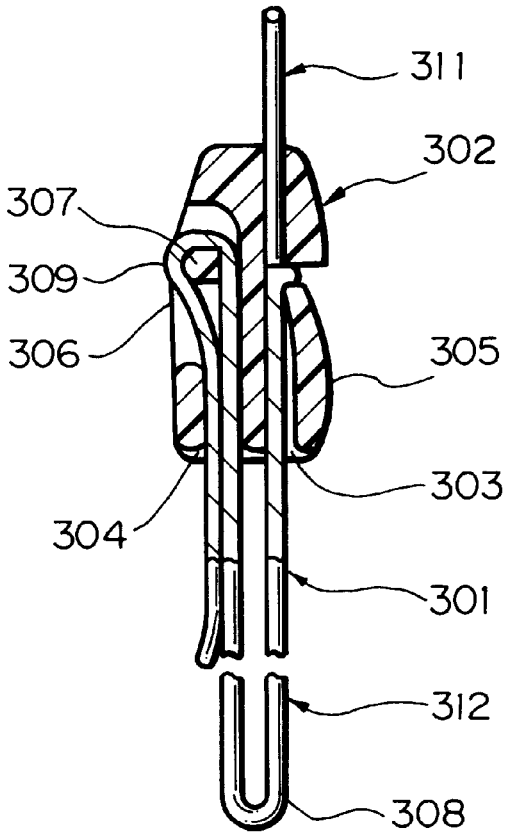
Fig. 2 PRIOR ART
FIG. 2 is a section showing another conventional hand strap.

FIG. 2 shows another conventional hand strip which is disclosed in Japanese Patent Laid-Open Publication No. 8-10031 mentioned earlier. As shown, the hand strap is made up of a first string portion 312, a second string portion 311, and a buckle member 302 connecting the two string portions 312 and 311 to each other. The buckle member 302 includes a first insertion portion 303 including locking means 305, a second insertion portion 304, and a fold-back portion 306 including a lever 307. After a string 301 including the first string portion 312 has been inserted into the first insertion portion 303, it is folded back to form a first loop 308. The end of the first loop 308 is inserted in the second insertion portion 304 and then folded back to form a second loop 309 wrapping around the lever 307. The end of the second loop 309 is led out from the second insertion portion 304. The length of the hand strap, i.e., the length of the second string portion 312 may be changed by changing the length of the string 301 extending out from the second insertion portion 304. The adjusted length of the hand strip is maintained by the second loop 309 wrapping around the lever 307.

The conventional hand straps described above each has some problems discussed earlier.

Figure 3:
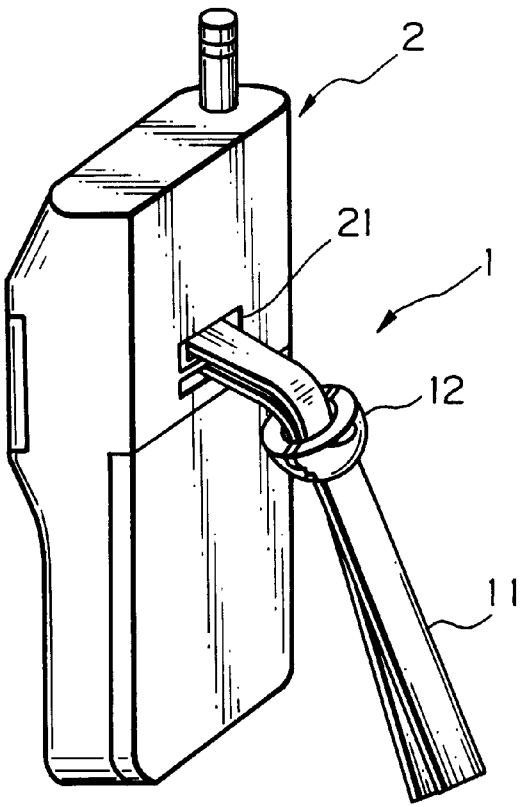
FIG. 3 is a perspective view showing a hand strap embodying the present invention and mounted on a portable apparatus.

Referring to FIG. 3, a hand strap embodying the present invention and applied to a handy phone by way of example will be described. As shown, the hand strap, generally 1, includes a string-like or strip-like strap body 11 anchored at one end to an engaging portion 21 formed in the housing of a handy phone 2. The other end of the strap body 11 is passed through a stop 12. The stop 12 is locked to the strap body 11 at any desired position and prevents the user's fingers holding the strap body 11 from slipping. The strap body 11 is folded back at the engaging portion 21 and used in the form of two strings or strips.

Figure 4:
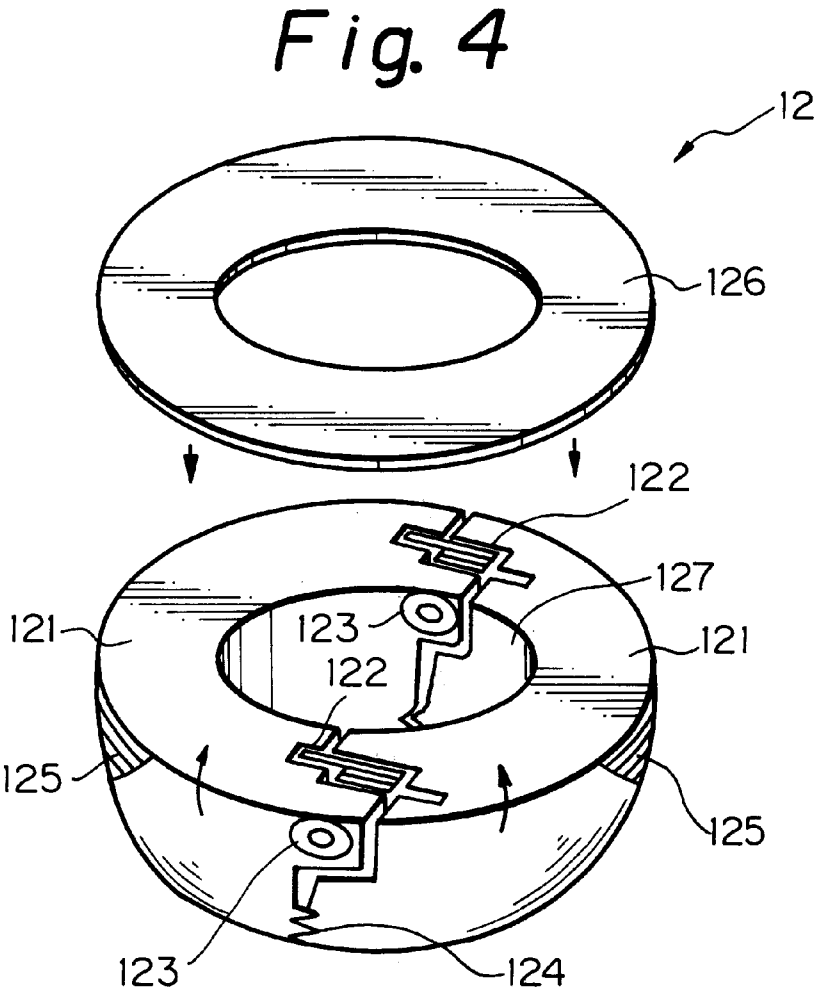
FIG. 4 is a perspective view showing a specific configuration of a stop included in the illustrative embodiment.

FIG. 4 shows the configuration of the stop 12 in detail. As shown, the stop 12 includes a first and a second stop body 121 each of which is formed with saw-toothed mating portions 124 at its one end. The mating portions 124 of the stop bodies 121 are held in engagement with each other. The stop bodies 121 are connected together by a pair of hinges 123. An anti-slip portion 125 is formed at the other end of each stop body 121. When the user of the handy phone 1 squeezes the anti-slip portions 125 with fingers, the mating portions 124 open away from each other about the hinges 123. Springs 122 are respectively included in the hinges 123 in order to bias the mating portions 124 of the stop bodies 121 toward each other. The stop bodies 121 form a bore 127 therebetween in the vicinity of the hinges 123, so that the strap body 11 can be inserted into the bore when the mating portions 124 are opened. A deformable pad 126 i adhered to the top of the stop bodies 121.

The pad 126 is formed of rubber or silicone and deformable when the mating portions 124 are opened and closed. In addition, the pad 126 prevents the user's fingers from touching the hinges 123 or the springs 122. If desired, the pad 126 may be divided into two parts at positions corresponding to the hinges 123, and the two parts may be respectively formed integrally with the anti-slip portions 125.

How the hand strap 1 is used will be described hereinafter. While the strap body 11 is generally 5 mm to 10 mm wide and about 200 mm long, the strap body 11 is about 400 mm long in total because it is folded back at the engaging portion 21 of the handy phone 2. The stop 12 has a diameter ranging from about 15 mm to about 30 mm which is not bulky, but is great enough to prevent the user's fingers from slipping.

Figure 5:
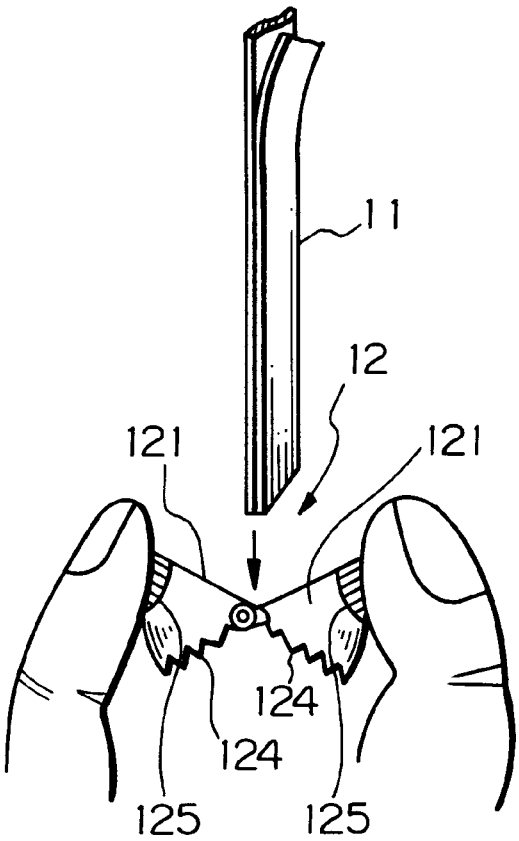
FIG. 5 is a side elevation showing how a strap body included in the illustrative embodiment is inserted into the step of FIG. 4.

As shown in FIG. 5, the user opens the stop 12 about the hinges 123 and then inserts one end of the strap body 11 into the stop 12. Specifically, when the operator squeezes and presses the anti-slip portions 125 of the stop 12, the mating portions 124 of the stop bodies 121 open away from each other against the action of the springs 122. Then, the user inserts the strap body 11 into the hole 127, as illustrated. Subsequently, the user slides the strap body 11 to a desired position while squeezing the anti-slip portions 121. When the user releases the anti-slip portions 121 at the desired position, the mating portions 124 are closed toward each other by the action of the springs 122, locking the stop 12 to the strap body 11.

Figure 6:
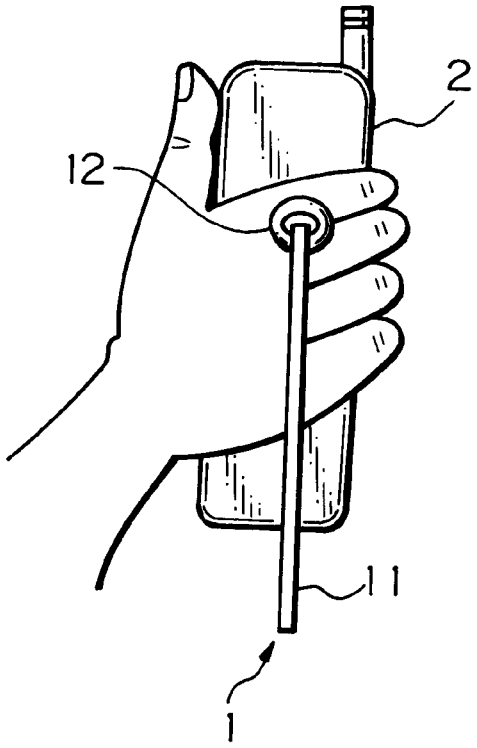
FIG. 6 shows a specific condition in which the apparatus is held by hand.

FIG. 6 shows a specific condition in which the user holds the handy phone 2 by using the hand strap 1. As shown, the stop 12 is locked to the strap body 11 at a position close to the phone 2, but about 2 cm apart from the engaging portion 21. In this specific condition, the user holds the handy phone 2 while putting the forefinger and middle finger on both sides of the strap body 11. As a result, the user's hand is held between the phone 2 and the stop 12 in a natural condition, so that the user can hold the phone 2 without gripping it. Even when the user puts the hand off the phone 2, the phone 2 is still held by the user via the strap body 11 and stop 12 and prevented from slipping down.

Figure 7:
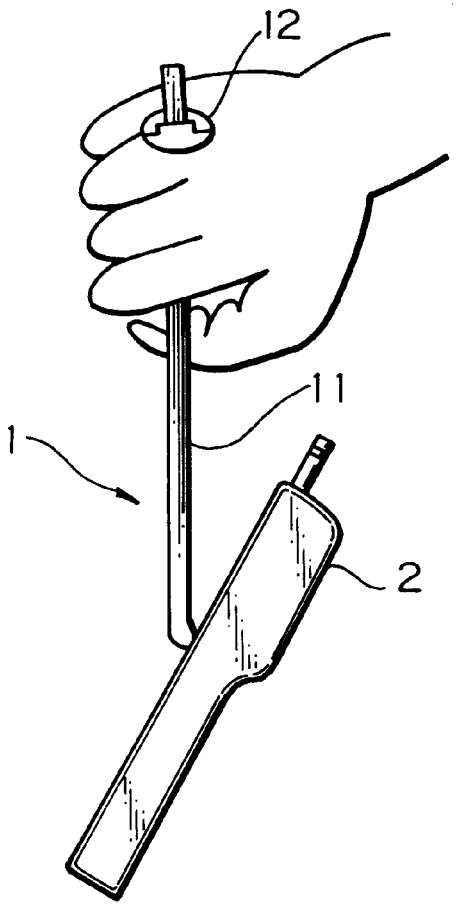
FIG. 7 shows a specific condition in which the apparatus is carried.

FIG. 7 shows a specific condition in which the user carries the handy phone 2. As shown, the user locks the stop 12 to the end portion of the strap body 11 and puts the strap body 11 between two fingers. In this condition, the user grips the strap body 11 and carries the phone 2 with the stop 12 abutting against the fingers. Again, the phone 2 is prevented from dropping because it is held by the strap body 11, stop 12, and the user's fingers. The user can therefore easily and surely grip the strap without putting the user's hand in a loop.

Figure 8:
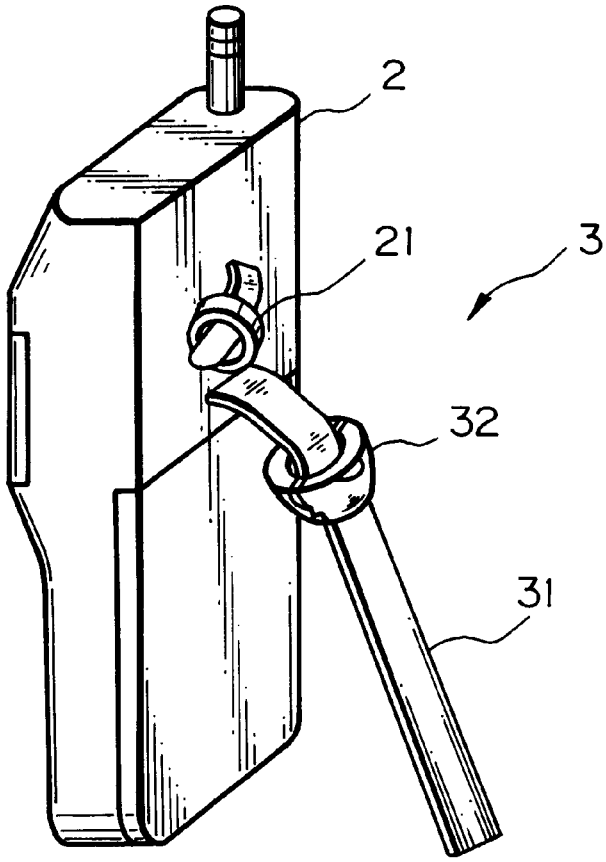
FIG. 8 is a perspective view showing an alternative embodiment of the present invention.

FIG. 8 shows an alternative embodiment of the present invention. As shown, a hand strap 3 includes a single strip-like strap body 31. The strap body 31 has its one end inserted in and tied to the engaging portion 21 of handy phone 2. A metal fitting may be used to fasten the strap body 31 to the engaging portion 21, if desired. A stop 32 is identical in configuration with the stop 12, FIG. 3. This embodiment is practicable with a single strap and therefore lower in cost than the previous embodiment.

The stop 12 or 32 may be so constructed as to be slidable toward the engaging portion 21 of the handy phone 2, but not slidable in the other direction, without the user's fingers touching the anti-slip portions 125. This can be done if the saw-toothed mating portions of the two bodies are formed with inclined teeth.

The stop bodies 121 of the stop 12 or 32 may be provided with any desired appearance, e.g., the appearance of a mascot such as an animal, person or object. Alternatively, a mascot produced independently of the hand strap may be added to the stop bodies 121 to make them fashionable. Moreover, two or more stops 12 or 32 may be fitted on the strap body 11 for implementing various ways of use.

In summary, it will be seen that the present invention provides a hand strap for a portable apparatus having various unprecedented advantages, as enumerated below.

(1) The hand strap is made up of a strap body implemented by one or two strings or strips anchored to the engaging portion of the apparatus, and a stop capable of being locked to the strap body at any desired position. The hand strap can therefore be held without requiring the user to put the user's hand in a loop. This allows the user to safely carry the apparatus simply by gripping the strap.

(2) The user can move the stop in order to change the length of the strap simply by squeezing the anti-slip portions of the stop with two fingers. Particularly, when the length of the strap is reduced, the long excess portion of the strap does not hang down or obstruct the user's operation.

(3) The engaging portion of the apparatus is so located as to coincide with the user's hand holding the apparatus. The stop can therefore be locked to the strap body in close proximity to the engaging portion, allowing the user to surely hold the apparatus.

(4) The strap implemented by only one or two strings is low cost.

Various modifications will become possible for those skilled in the art after receiving the teachings of the present disclosure without departing from the scope thereof.

What is claimed is:

1. A hand strap for a portable apparatus, the hand strap comprising:

a single layer strap body anchored at one end to an engaging portion formed in a preselected position of a casing included in said portable apparatus; and a stop capable of being locked to said single layer strap body at any desired position with the other end of said single layer strap body being passed through said stop, said stop preventing user's fingers holding the strap body from slipping.

2. A hand strap as claimed in claim 1, wherein said stop comprises:

a first and a second body respectively having saw-toothed ends mating with each other;

hinges connecting said first body and said second body such that when the other ends of said first body and said second body are squeezed by fingers, said saw-toothed ends move away from each other, springs respectively included in said hinges for constantly biasing said saw-toothed ends toward each other; and a bore formed between said first body and said second body in the vicinity of said hinges for inserting said strap body.

3. A hand strap as claimed in claim 2, wherein said saw-toothed ends of said first body and said second body have inclined teeth in order to allow said strap body to be slid in a first direction but not in an opposite direction.

4. A hand strap as claimed in claim 1, wherein said stop comprises a plurality of stops fitted on said strap body.

5. A hand strap for a portable apparatus, the hand strap comprising:

a strap body anchored at one end to an engaging portion formed in a preselected position of a casing included in said portable apparatus; and a stop capable of being locked to said strap body at any desired position with the other end of said strap body being passed through said stop, said stop preventing user's fingers holding the strap body from slipping, said stop comprising:

a first and a second body respectively having saw-toothed ends mating with each other, said saw-tooth ends of said first body and said second body having inclined teeth allowing said strap body to be slid in a first direction but not in an opposite direction;

hinges connecting said first body and said second body such that when other ends of said first body and said second body are squeezed, said saw-toothed ends move away from each other;

a spring for constantly biasing said saw toothed ends towards each other; and a bore formed between said first body and said second body in the vicinity of said hinges for inserting said strap body.

* * * * *

UNITED STATES PATENT AND TRADEMARK OFFICE

CERTIFICATE OF CORRECTION

PATENT NO. : 6,217,095 B1
DATED : April 17, 2001
INVENTOR(S) : K. Yamada

It is certified that error appears in the above-identified patent and that said Letters Patent is hereby corrected as shown below:

Title page,
Item [56], References Cited, FOREIGN PATENT DOCUMENTS:
"7/1986" should read -- 1/1986 --

Column 1,
Line 52, "port ion" should read -- portion --

Column 3,
Lines 34-35, "squeezes and presses" should read -- squeezes --

Signed and Sealed this

Twenty-sixth Day of February, 2002

*Attest:*

*Attesting Officer*

JAMES E. ROGAN
*Director of the United States Patent and Trademark Office*